US006832757B2

(12) United States Patent
Reist et al.

(10) Patent No.: US 6,832,757 B2
(45) Date of Patent: Dec. 21, 2004

(54) CLAMP WITH OPENING ELEMENT

(75) Inventors: Walter Reist, Hinwil (CH); Willi Leu, Pfaffikon (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 10/220,782

(22) PCT Filed: Jan. 23, 2001

(86) PCT No.: PCT/CH01/00049

§ 371 (c)(1),
(2), (4) Date: Nov. 22, 2002

(87) PCT Pub. No.: WO01/64560

PCT Pub. Date: Sep. 7, 2001

(65) Prior Publication Data

US 2003/0146634 A1 Aug. 7, 2003

(30) Foreign Application Priority Data

Mar. 3, 2000 (CH) ..... 0416/00

(51) Int. Cl.[7] ..... B65H 5/30
(52) U.S. Cl. ..... 270/52.25; 270/52.23
(58) Field of Search ..... 270/52.14, 52.16, 270/52.19, 52.23, 52.24, 52.25, 52.27

(56) References Cited

U.S. PATENT DOCUMENTS

| | | | | |
|---|---|---|---|---|
| 3,713,650 A | | 1/1973 | Hodgkinson et al. | |
| 4,320,894 A | | 3/1982 | Reist et al. | |
| 5,065,994 A | * | 11/1991 | Hatt | 270/52.23 |
| 5,112,036 A | * | 5/1992 | Hatt | 270/52.23 |
| 5,248,135 A | * | 9/1993 | Leu | 270/52.27 |
| 5,292,111 A | * | 3/1994 | Hansch | 270/52.27 |
| 5,388,816 A | * | 2/1995 | Petersen | 270/52.23 |
| 5,485,989 A | | 1/1996 | McCay et al. | |
| 6,003,859 A | | 12/1999 | Reist | |
| 6,095,511 A | * | 8/2000 | Jager | 270/52.29 |

FOREIGN PATENT DOCUMENTS

| | | |
|---|---|---|
| DE | 640 559 | 12/1936 |
| DE | 640559 | 12/1936 |
| DE | 1035572 | 7/1958 |
| DE | 10 35 572 B | 7/1958 |
| DE | 10 93 296 B | 11/1960 |
| DE | 1093296 | 11/1960 |
| EP | 0 476 859 A2 | 3/1992 |
| EP | 0 572 221 A1 | 12/1993 |
| EP | 0 644 142 A1 | 3/1995 |
| EP | 0 708 042 A1 | 4/1996 |

* cited by examiner

*Primary Examiner*—Patrick Mackey
(74) *Attorney, Agent, or Firm*—Brinks Hofer Gilson & Lione

(57) ABSTRACT

The clamp has two interacting clamp elements (14) which can be moved relative to one another. These are intended for retaining a sheet-like article (70). The clamp (12) also has a holding-open element (20) which is intended for engaging between two parts (78, 78') of the article and, when the clamp elements (14) are located in the closed position (18'), for keeping these parts (78, 78') separate from one another and thus holding the article (70) open.

12 Claims, 6 Drawing Sheets

CLAMP WITH OPENING ELEMENT

RELATED APPLICATIONS

This application is a nationalization of PCT application PCT/CH01/00049 filed Jan. 23, 2001. This application claims priority from the PCT application and Swiss Patent Application No. 2000 0416/00 filed Mar. 3, 2000.

The present invention relates to a clamp for retaining flexible, sheet-like articles with two or more parts as claimed in the preamble of patent claim 1 and to an apparatus for transporting flexible, sheet-like articles with two or more parts as claimed in patent claim 11.

A clamp of this type is known from EP-A-0 767 125. It has two clamping jaws mounted pivotably on a pin. These clamping jaws are moved into the closed position, and retained therein, by means of a closing arrangement. The closing arrangement is formed by a pivotable bracket which has two clamping bodies which are each seated on a flexurally rigid carrying arm. The two clamping bodies, in the closed position of the clamping jaws, are located in a latching depression formed on the outside of the clamping jaws and subject the two clamping jaws to a closing force. By virtue of the closing arrangement being pivoted upward from the closed position into a released position, the clamping jaws are released and can pivot into the open position, for example, by spring force. The clamps are intended for retaining sheet-like articles, in particular flexible sheet-like articles, such as printed products with one or more sheets, and can be guided for transporting the articles along a transporting path. As a result of the narrow construction of the clamp it is suitable, in particular, for the buffer-storage of the individually retained articles.

It is an object of the present invention to develop the known clamp such that it can perform further functions. A further object of the invention is to provide an apparatus for transporting flexible, sheet-like articles with two or more parts.

These objects are achieved by a clamp having the features of claim 1 and by an apparatus having the features of claim 11.

A clamp which is intended for retaining an article is assigned a holding-open element by means of which the article retained by the clamp is held open. This makes it possible for the article retained by the clamp to be processed in different ways. For example, the held-open article can be deposited in straddling fashion on saddle-like rests or it is possible for inserts, trade samples or the like to be introduced into the held-open article.

Preferred embodiments of the clamp according to the invention are defined in the dependent claims.

The present invention is explained in more detail with reference to the exemplary embodiments illustrated in the drawing, in which, purely schematically:

Figure 1:
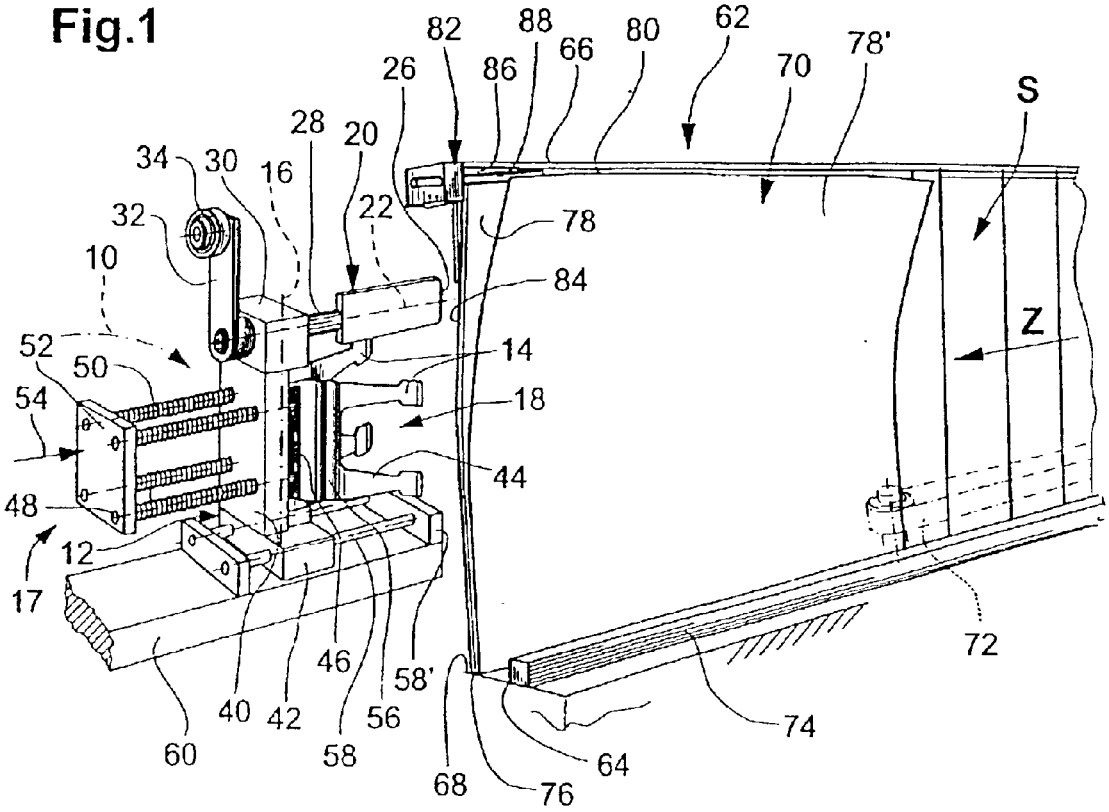
FIG. 1 shows a perspective illustration of a clamp according to the invention, having two clamp elements and a holding-open element, prior to receiving a multi-part, open sheet-like article, and also of a feed apparatus.

The apparatus shown in FIGS. 1 to 4 has a plurality of clamps 12 which are arranged one behind the other and are driven in circulation along a movement path 10, only one of the clamps 12 being shown in each of these figures. The clamp 12 has two interacting clamp elements 14 which can be pivoted about an axis 16 and can be transferred by means of a control arrangement 17 from an open position 18, in which the two clamp elements 14 are arranged in a V-shaped manner relative to one another (see FIGS. 1 and 2), into a closed position 18' (FIGS. 3 and 4), in which the clamp elements 14 are intended for retaining an article 70 arranged between them. The article is a folded printed product but may also be constituted by other types of flexible sheet-like articles with two or more parts. Within the context of the present invention, a folded sheet has two parts which are connected to one another at the fold.

Figure 2:
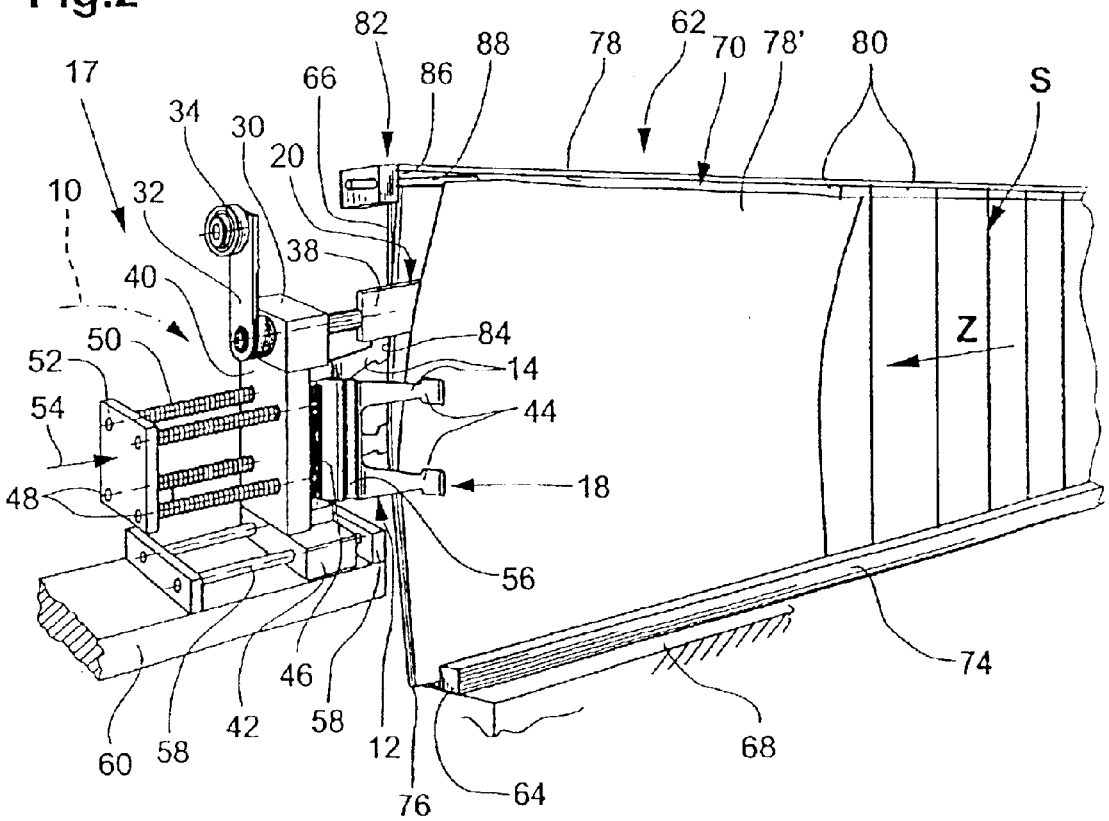
FIG. 2 shows, in the same illustration as FIG. 1, the clamp with the clamp elements located in the open position as the holding-open element is moved into the opened sheet-like article.
Figure 3:
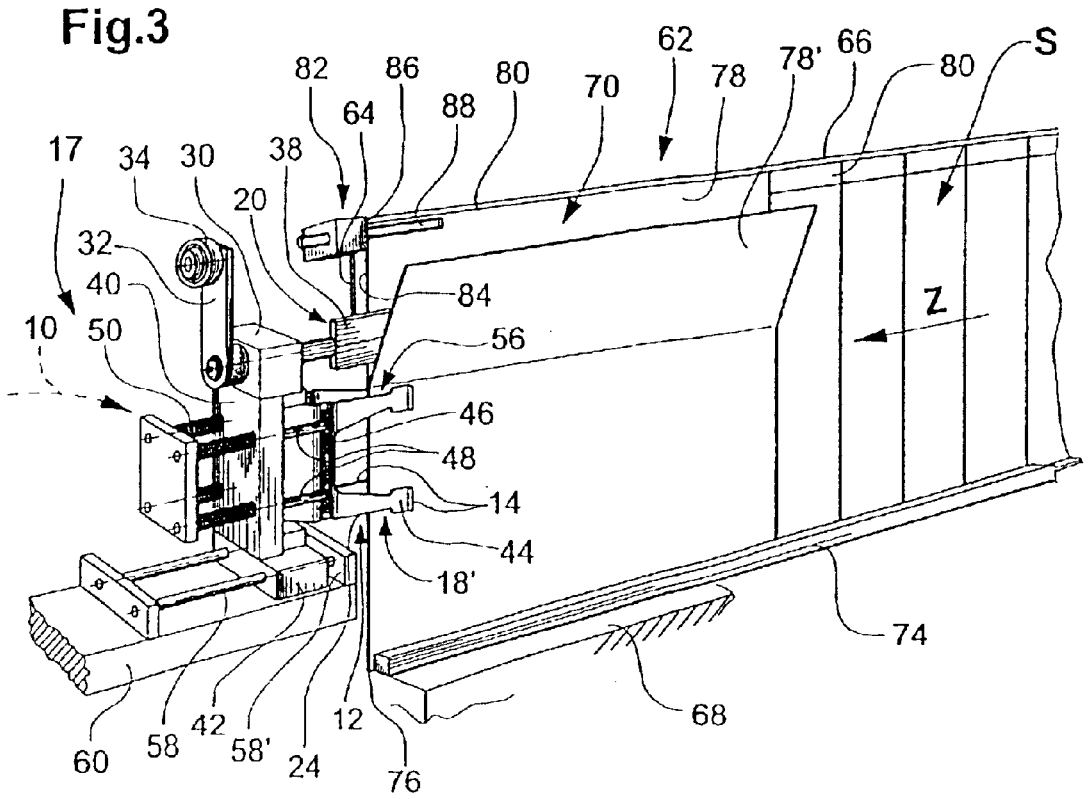
FIG. 3 shows, in the same illustration as FIGS. 1 and 2, the clamp with clamp elements retaining the article in the closed position and with the holding-open element arranged between two parts of the article.
Figure 4:
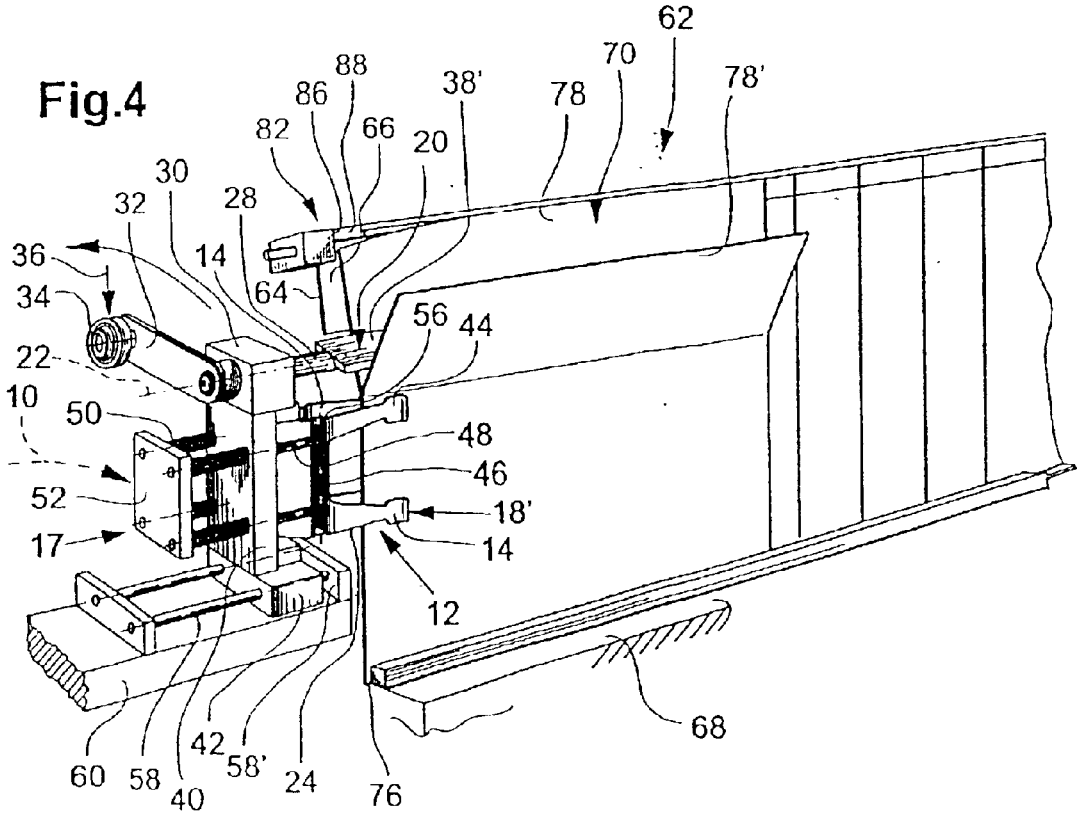
FIG. 4 shows, in the same illustration as FIGS. 1 to 3, the clamp with the clamp elements retaining the article and with the holding-open element rotated through approximately 90° into a spreading position in order for the retained article to be opened further.

The clamp 12 also has a holding-open element 20, which is of tongue-like design and can be rotated about its longitudinal axis 22 which runs at right angles to the axis 16 and is located in a clamp plane 24 defined by the clamp elements 14 located in the closed position 18'. As seen in the direction of the longitudinal axis 22, the free end 26 of the holding-open element 20 is located approximately at the free end of the clamp elements 14 moved into the closed position 18'. The tongue-like holding-open element 20 is arranged at the end of a shank 28 which is arranged coaxially with respect to the longitudinal axis 22, engages through a bearing body 30 and is mounted on the latter such that it can be rotated about the longitudinal axis 22. Seated on the shank 28 on the opposite side to the holding-open element 20, in respect of the bearing body 30, is a control lever 32, at the free end of which a control roller 34 is mounted in a freely rotatable manner. This is intended for interacting with a control element 36, illustrated by an arrow in FIG. 4, for example a stationary control guide element, in order to rotate the holding-open element 20. In FIGS. 1 to 3, the tongue-like holding-open element is located in the holding-open position 38, in which the longer extent of the cross section runs in or parallel to the clamp plane 24. FIG. 4 shows the holding-open element 20 in the spreading position 38', in which the abovementioned extent runs at least more or less at right angles to the clamp plane 24.

The bearing body 30 is fastened on the end side of a guide body 40 which, for its part, is fastened, on the side remote from the bearing body 30, on a slide 42. The two clamp elements 14 are arranged on the guide body 40. In the present case, the two clamp elements 14 are produced from a common, single-piece bent spring-steel sheet which, in the region of the bend—i.e. in the region of connection between the two more or less planar legs—is fastened on the guide body 40. The two legs of the steel sheet are recessed from the free end, with the result that each leg has two fingers 44, which together form a clamp element 14. Arranged on the outer side of each clamp element 14 is a circle-arc-shaped clamping body 46 which runs parallel to the axis 16 and is fastened on two flexurally rigid guide rods 48. The latter run parallel to the longitudinal axis 22, engage through the guide body 40 and are mounted on the latter such that they can be displaced in the longitudinal direction. On that side of the guide body 40 which is directed away from the clamping bodies 46, a compression spring 50 engages around each guide rod 48 and is supported, on the one hand, on the guide body 40 and, on the other hand, on an actuating plate 52 common to all the guide rods 48.

In the open position 18 of the clamp elements 14, the clamping bodies 46 are retained in abutment against the guide body 40 by the compression springs 50. By means of a control element 54, for example a guide element, a cylinder/piston subassembly or the like, the clamping bodies 46 can be moved in the direction of the guide rods 48, away from the guide body 40, in the direction of the free end of the clamp elements 14. In this case, the clamping bodies 46 slide along the outer side of the clamp elements 14 and pivot the latter into the closed position 18'. At a distance from the guide body 40, the clamp elements 14 have latching depressions 56, in which the clamping bodies 46 end up when the clamp 12 is closed and, as a result of the reaction force of the clamp elements 14 to which they are subjected, are retained in a stable manner there such that, when the actuating plate 52 is released by the control element 54, they are retained counter to the force of the compression springs 50 (FIG. 4).

In order to transfer the clamp elements 14 from the closed position 18' back into the open position 18, the actuating plate 52 is pulled back, by means of a further control element, counter to the arrow direction shown in FIG. 1, with the result that the clamping bodies 46 move out of the latching depression 56 and are then brought into abutment against the guide body 40 by the force of the compression springs 50. The clamping bodies 46 then release the clamp elements 14, which as a result of the inherent resilience, corresponding to the position of the clamping bodies 46, move into the open position 18. Of course, it is conceivable for the clamp elements 14 to be mounted in a rotatable manner on a pin and to be prestressed into the open position by means of a spring.

The slide 42 is mounted on two guide rails 58 which run parallel to the longitudinal axis 22 and the guide rods 48 and are fastened on a carrier plate 58' arranged on a carrier 60. The carrier 60 can be fastened, for example, on a carrier wheel, on a pulling element or on a slide or carriage which is guided in rails.

The clamp shown in FIGS. 1 to 4 also has a feed apparatus 62, the movement path 10 of the clamp 12 running past the downstream end 64 of the latter, as seen in the feed direction Z, at right angles to the feed direction Z. The feed apparatus 62 has a supporting plate 66, which is slightly inclined from the vertical, and a base element 68. Flexible, sheet-like articles 70, in the present case folded printed products with a number of pages, are conveyed in imbricated formation S in abutment against the supporting plate 66, the article 70 which is in front in each case resting on the following one. A conveying belt 72, which is indicated by chain-dotted lines and driven in circulation in the feed direction Z, transports the imbricated formation S in the feed direction Z toward the downstream end 64 of the supporting plate 66. The latter has a cutout which runs from said end 64 and allows the clamp 12 to have access to the respectively foremost article 70 of the imbricated formation S.

Fastened on the base element 68, at a spacing from the supporting plate 66, is a guide strip 74, which runs in feed direction Z and, together with the supporting plate 66, forms a guide groove for the fold edge 76 of the articles 70.

As can be gathered from FIGS. 1 to 3 in particular, the articles 70 are folded eccentrically, with the result that the part 78 of the articles 70, said part being directed toward the supporting plate 66, has a so-called overfold 80 projecting in relation to the other part 78'.

Located at the end 64 of the supporting plate 66 is an opening apparatus 82, which is intended for lifting off the part 78' from the part 78 of the respective article 70 at the leading edge 84 of the latter, as seen in the feed direction Z. For this purpose, the opening apparatus 82 has a stop 86 and a restraining bar 88, which projects from the stop contrary to the feed direction Z. This restraining bar is curved in its free end region and, together with the supporting plate 66, forms a narrowing guide nip for the overfold 80.

The embodiment of the clamp according to the invention which is shown in FIGS. 1 to 4 functions as follows. In FIG. 1, a clamp 12 is located in the receiving position at the downstream end 64 of the feed apparatus 62. The clamp elements 14 are located in the open position 18 and the holding-open element 20 is located in the holding-open position 38. The slide 42 with the clamp 12 fastened thereon is located at that end of the guide rails 58 which is remote from the feed apparatus 62. The overfold 80 of the part 78 of the article 70, said part being directed toward the supporting plate 66, is introduced between the supporting plate 66 and the restraining bar 88 and the leading edge 84 of said part 78 butts against the stop 86. As a result of the articles 70 being conveyed further in the feed direction Z, the leading edge 84 and an adjoining region of the part 78 are bent out away from the supporting plate 66, as a result of which the other part 78' lifts off from the part 78.

As a result, as is shown in FIG. 2, the clamp 12 together with the holding-open element 20 is then moved, by means of the control element 54, along the guide rails 58 in the direction of the feed apparatus 62, as a result of which, on the one hand, the clamp elements 14 clasp the relevant article 70 from the leading edge 84 and, on the other hand, the holding-open element 20 is inserted between the parts 78, 78' of the article 70, said parts having been lifted off from one another. This movement takes place counter to the feed direction Z until the slide 42 comes into abutment against the corresponding carrier plate 58', on which the guide rails 58 are fastened.

When the actuating plate 52 is moved further by means of the control element 54, as FIG. 3 shows, the clamp elements 14 are then transferred into the closed position 18', as a result of which they grip the article 70. In this case, on that side of the clamp elements 14 which is directed away from the fold edge 76—outside the region of action of said clamp elements—the two parts 78 and 78' of the article 70 are held open by means of the holding-open element 20 engaging therebetween.

As the clamp 12 moves away from the feed apparatus 62 along the movement path 10, on the one hand the overfold 80 is pulled out from under the region between the restraining bar 88 and the supporting plate 66 and, on the other hand, by virtue of the holding-open element 20 being rotated about its longitudinal axis 22 by means of the control element 36, the two parts 78, 78' of the article 70 are spread further apart from one another and the article 70 is thus opened further.

The clamp 12, together with the holding-open element 20, can be driven continuously along the movement path 10. In this case, the movement of the clamps 12 and of said articles 70 are coordinated with one another such that each clamp 12 grips an article 70 and transports it further.

Figure 5:
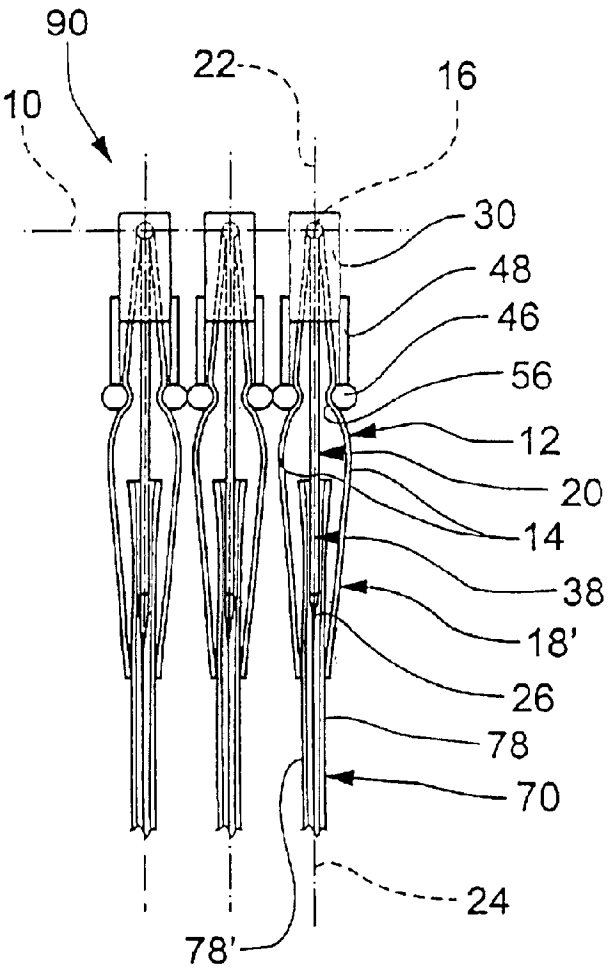
FIG. 5 shows a view of a plurality of clamps, each retaining a sheet-like article, with a holding-open element between in each case two parts of the relevant article, the clamps being located in a buffer-storage section of a transporting apparatus.

FIG. 5 shows three clamps 12, with associated holding-open element 20, which are located in a buffer-storage section 90 of a transporting apparatus. This buffer-storage section 90 is arranged in a portion of the movement path 10 which is arranged downstream of the feed apparatus 62. Each of these clamps 12 retains an article 70 between its parts 78, 78', in which the holding-open element 20, located in holding-open position 38, engages. In this case, the rotation of the holding-open element 20 into the spreading position 38' which has been explained in conjunction with FIG. 4 has not yet taken place, with the result that the clamps 12, together with the articles 70, require a minimal amount of space and may be arranged such that they butt against one another in the buffer-storage section 90.

Figure 6:
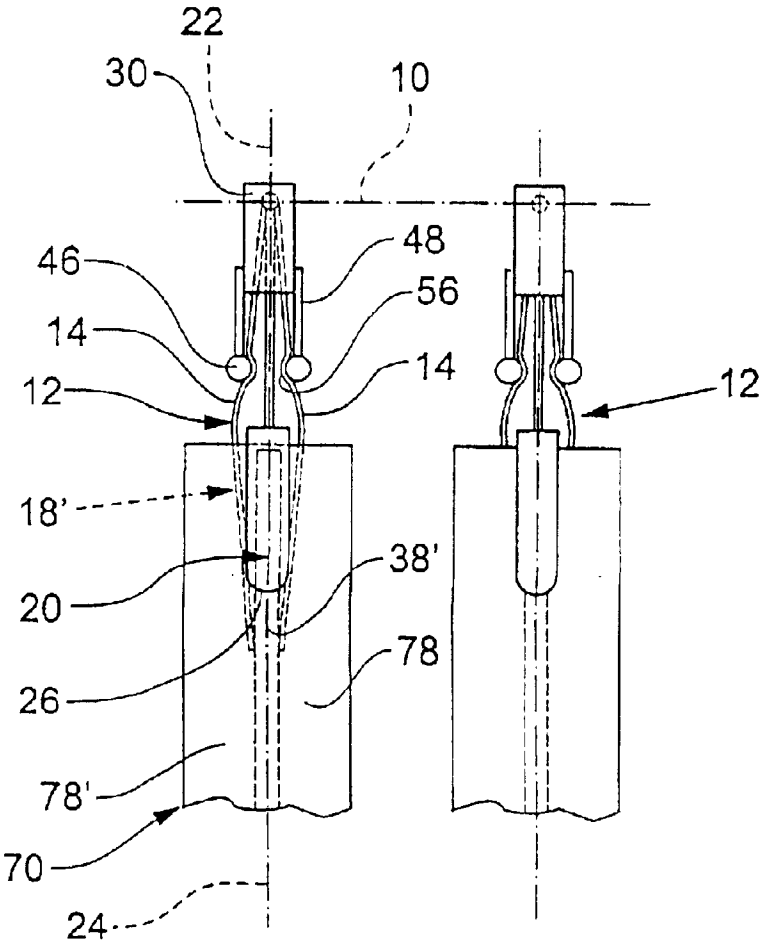
FIG. 6 shows, in the same illustration as FIG. 5, two article-retaining clamps with holding-open element rotated into the spreading position.

The clamps 12 can be moved out of the buffer-storage section 90 with the spacing between them being increased in the process, which allows the holding-open element 20 to be rotated into the spreading position 38' and allows the articles 70 to be opened further as a result, as FIG. 6 shows.

Figure 8:
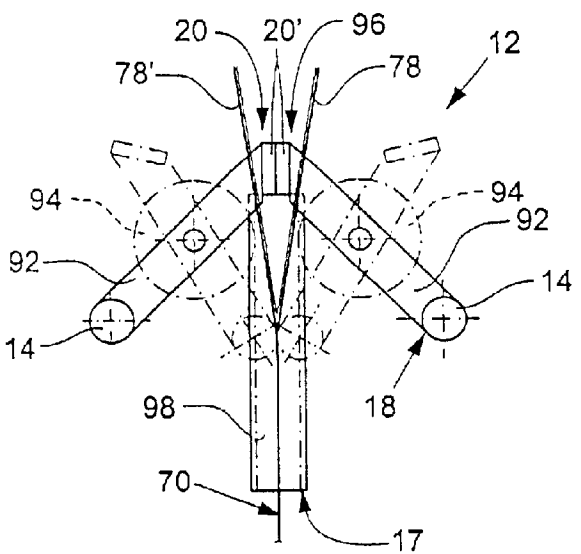
FIG. 8 shows, in the same illustration as FIG. 7, the clamp shown in FIG. 7, but this time with the clamp elements in the closed position.
Figure 7:
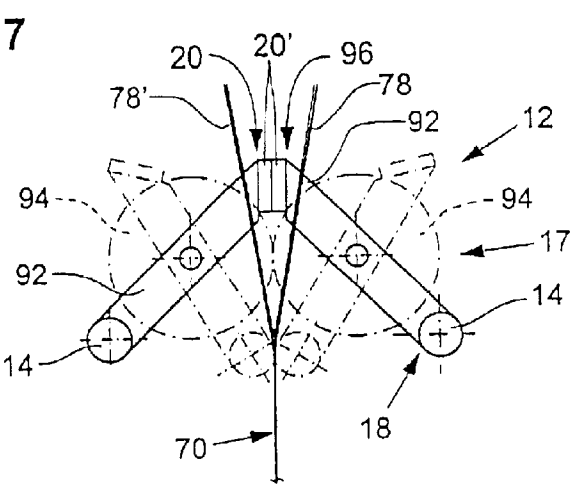
FIG. 7 shows a view of a further embodiment of a clamp with holding-open element in the open position of the clamp elements.

FIGS. 7 and 8 show a further embodiment of a clamp 12 with an associated holding-open element 20 according to the present invention. The clamp elements 14 are of bar-like design and run parallel to one another. The holding-open element 20 is formed by two holding-open bars 20' which run parallel to the clamp elements 14. In each case one clamp element 14 and one holding-open bar 20' are fastened at the two ends of a lever 92, the two levers being mounted in an axis-parallel manner such that they can be rotated freely on a carrying element (not shown). Each of these levers 92 is connected to a gearwheel 94, these gearwheels meshing with one another in order for the levers 92 to be rotated in opposite directions. In the rest position 96, the two holding-open bars 20' butt against one another and the clamp elements 14 are located in an open position 18, in which they are spaced apart from one another.

FIG. 7 also shows an article 70 which has been opened by means of an opening apparatus 82, in which case, by virtue of the clamps 12 being displaced relative to the article 70, the two holding-open bars 20' are arranged between the two parts 78, 78' of the article 70 and the two clamp elements 14 are arranged outside the same. By virtue of the two levers 92 being rotated in opposite directions, the clamp elements 14 are moved toward one another into the closed position 18', in which case they clamp the article 70 firmly between them, see FIG. 8. At the same time as the clamp elements 14 are moved toward one another, the holding-open bars 20' are moved out of the rest position 96 into a spreading position 38', as a result of which the two parts 78, 78' are moved further apart from one another and the article 70 is thus opened further. The gearwheels 94 may be rotated by means of generally known control means.

Figure 10:
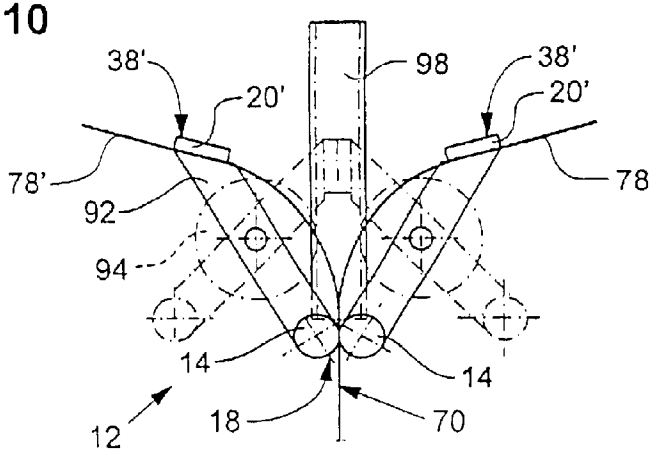
FIG. 10 shows, in the same illustration as FIG. 9, the clamp shown in FIG. 9, but this time with the clamp elements moved into the closed position.
Figure 9:
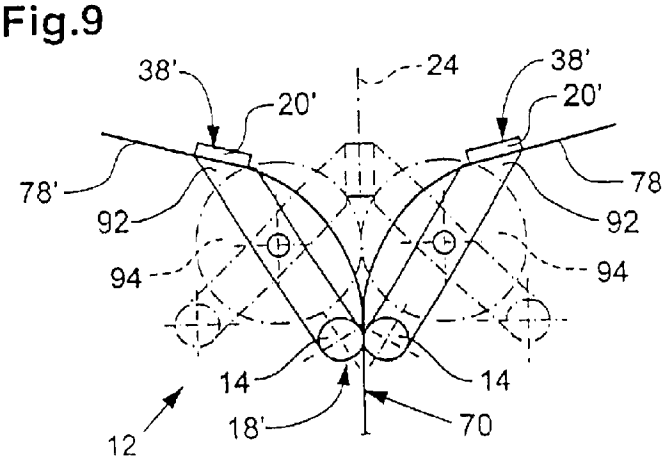
FIG. 9 shows a third embodiment of the clamp with a holding-open element and clamp elements located in the open position.

FIGS. 9 and 10 show an embodiment of the clamp 12 according to the invention, with associated holding-open element 20, which is very similar to FIGS. 7 and 8. It is also the case with this embodiment that in each case one holding-open bar 20' and one clamp element 14 of bar-like design are fastened on the two levers 92, which are mounted in an axis-parallel manner. The levers 92 are connected in a rotationally fixed manner to a gearwheel 94 in each case, the gearwheels 94 then meshing with a rack 98 arranged between them. By virtue of the rack 98 moving in a translatory manner, the clamp elements 14 are moved from the open position 18 into the closed position 18' and, to the same extent in the opposite direction, the holding-open bars 20' are moved from the rest position 96 into the spreading position 38', and vice versa. This embodiment allows the clamp 12 and the holding-open element 20 to be actuated by means of stationary guide elements, the clamp 12 being moved along these guide elements, as will be explained with reference to FIGS. 11 and 12.

Figure 12:
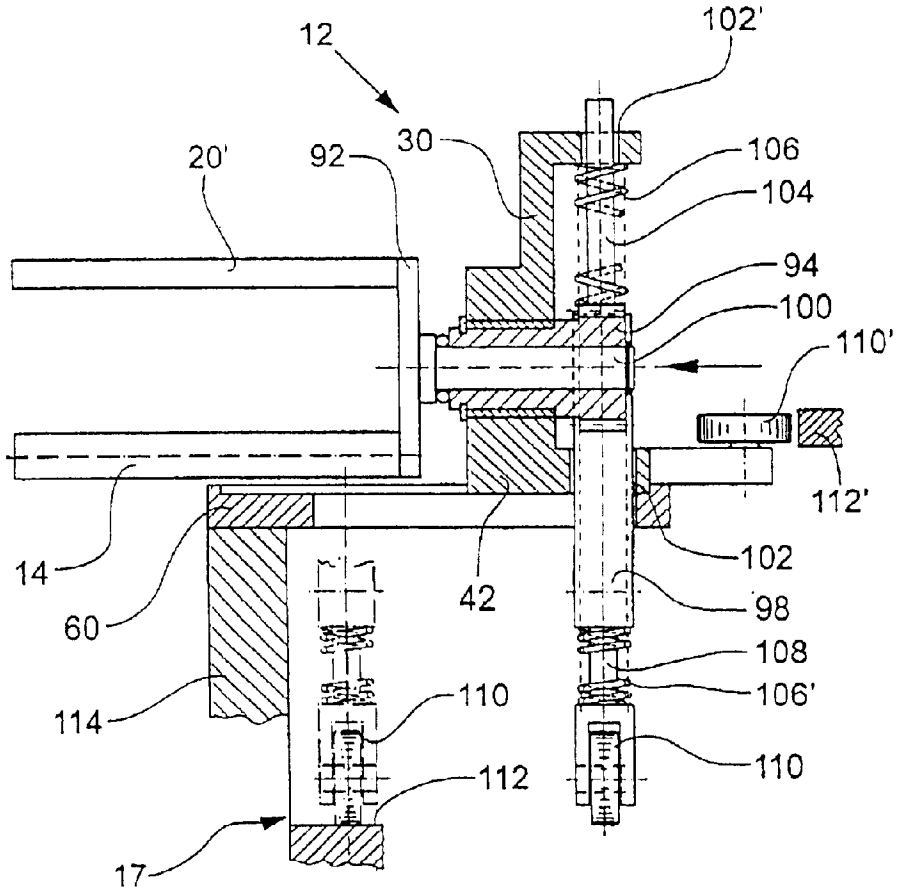
FIG. 12 shows a side view, partly in section, of the clamp and control arrangement according to FIG. 11.
Figure 11:
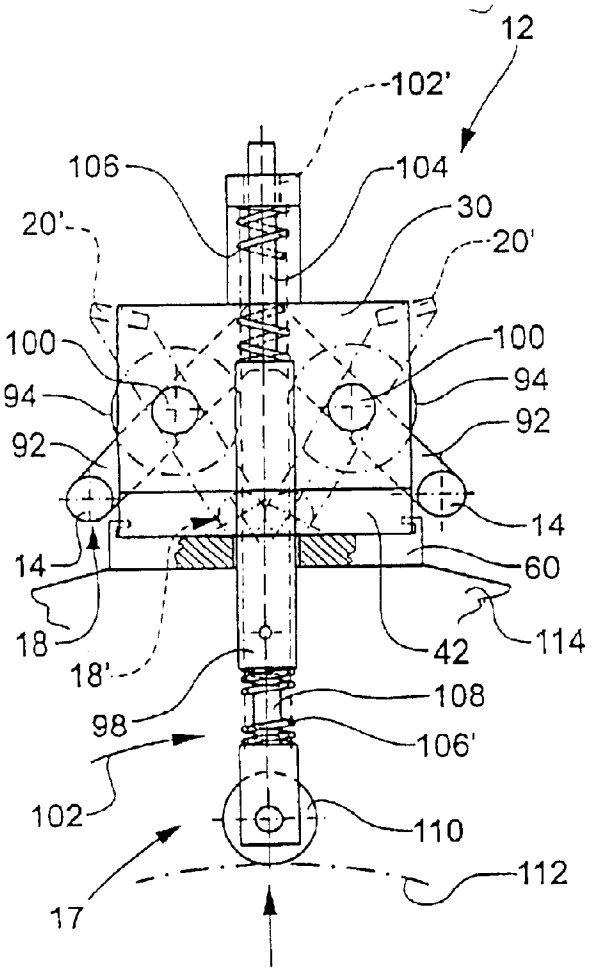
FIG. 11 shows the clamp shown in FIGS. 9 and 10 with a control arrangement for actuating the clamp elements and the holding-open element.

FIGS. 11 and 12 show a slide 42, on which a bearing body 30 is integrally formed. Two axis-parallel shafts 100 engage through the latter and have seated on them in a rotationally fixed manner, on the one hand, in each case one gearwheel 94 and, on the other hand, in each case one lever 92 with the clamp elements 14 and holding-open bars 20'. The double rack 98 is guided such that it can be moved in a translatory manner, on the one hand, in a guide through-passage 102 and, on the other hand, in a further guide through-passage 102' by way of its shank-like extension 104. A compression spring 106 engages around the extension 104 and is supported, on the one hand, on the rack 98 and, on the other hand, on the bearing body 30. From the end opposite the extension 104, the rack has a blind hole in which a carrier shank 108 is guided in a displaceable manner, a control roller 110 being mounted in a freely rotatable manner at the free end of said carrier shank. A further compression spring 106' acts between the rack 98 and the carrier shank 108. In each case, the force of the further compression spring 106' is greater than the force of the compression spring 106. The latter is intended for moving the clamp elements 14 from the closed position 18' into the open position 18, while the further compression spring 106' serves for allowing for the thickness of different articles 70 as the control roller 110 interacts with a control guide element 112—in the closed position 18' of the clamp elements 14.

The slide 42 is mounted on a cross-sectionally C-shaped carrier 60 such that it can be displaced in the longitudinal direction of the clamp elements 14 and holding-open bars 20'. The carrier 60 is fastened on a carrier wheel 114 which is driven in rotation about its axis. A plurality of uniformly distributed carriers 60 each with a clamp 12 may be arranged on the carrier wheel.

Mounted on the slide 42 is a further control roller 110', which interacts with a stationary displacement guide element 112'. By means of the displacement guide element 112', the clamp is moved in relation to the carrier 60 in a manner analogous to that explained with reference to FIGS. 1 to 4.

The apparatus according to FIGS. 11 and 12 functions as follows. The clamp 12 is driven continuously in the arrow direction along the circular movement path 10. At the feed apparatus (see FIGS. 1 to 4), the clamp 12 is moved in the direction of the feed apparatus by means of the displacement guide element 112' in order to grasp an article 70 by way of clamp elements 14 located in the open position 18. In this case, as is indicated by chain-dotted lines in FIG. 12, the control roller 110 ends up in the initial region of the control guide element 112 and then comes into abutment against the same as the carrier wheel 114 rotates further. The control guide element 112 then causes the rack 98 to move upward counter to the force of the compression spring 106, as a result of which the clamp elements 14 are moved into the closed position 18' and the holding-open bars 20' are moved into the spreading position 38'. For transporting the gripped articles 70 along the movement path 10, the clamp 12 is kept in the closed position by means of the control guide element 112 serving as a closing guide element. For discharging the articles 70, the guide element 112' follows a course in which it moves away from the movement path 10, as a result of which the clamp 12 can be opened by means of the compression spring 106.

Figure 13:
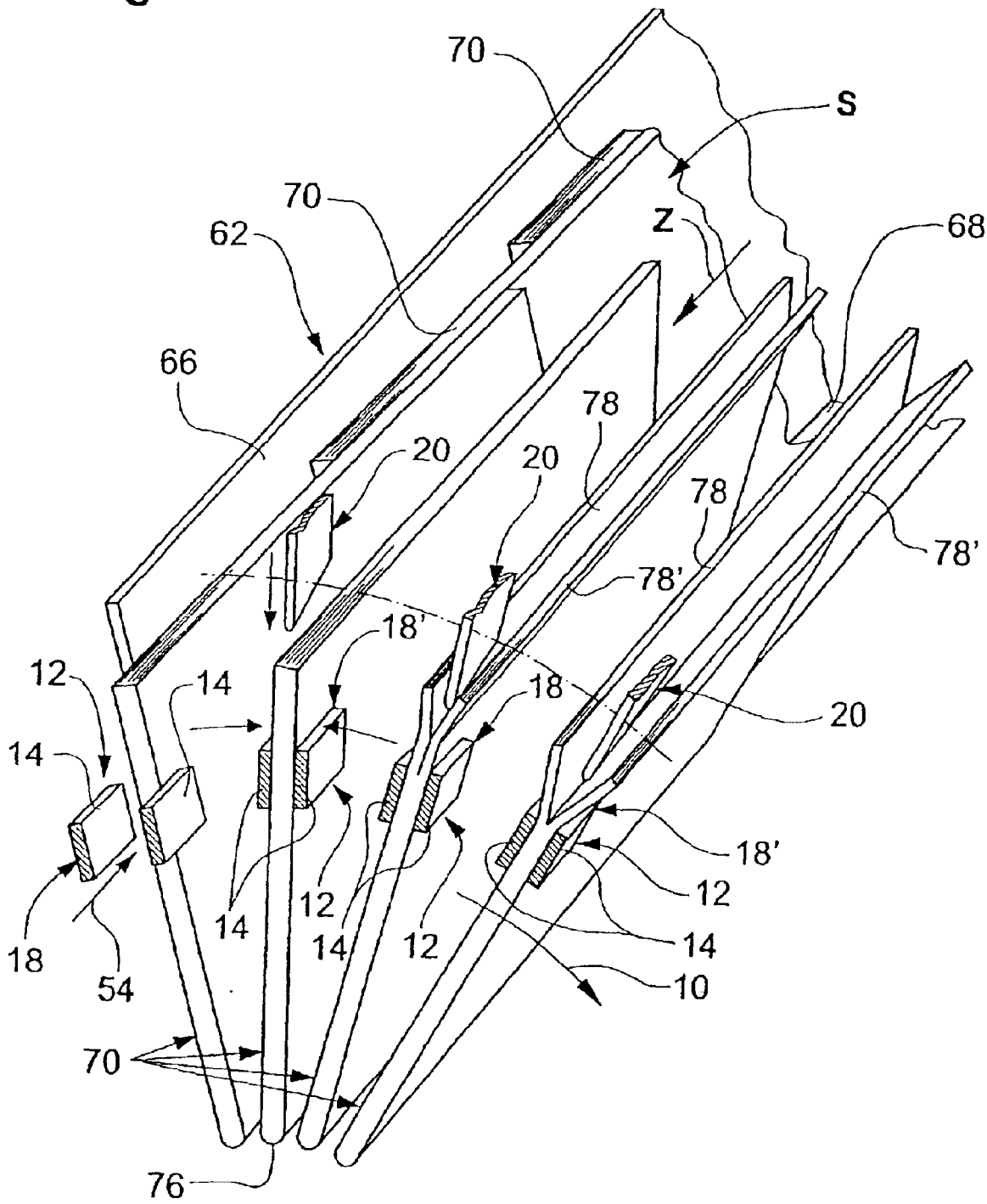
FIG. 13 shows a perspective illustration of a plurality of clamps with a holding-open element which also serves for opening the articles retained.

FIG. 13 shows a perspective illustration, obliquely from above, of the feed apparatus 62, with articles 70 conveyed in imbricated formation S in the feed direction Z, which is shown in FIGS. 1 to 4. In this example, the feed apparatus 62 does not have any opening apparatus 82. Of four clamps 12 arranged one behind the other along the movement path 10, only the clamp elements 14 are indicated. Each clamp 12 is assigned a holding-open element 20 which is intended for inserting, with its tip in front, between parts 78, 78' of the article 70 and then holding these open and separate from one another. In the example shown, for this purpose, the holding-open element 20 moves in the clamp plane 24 at right angles to the longitudinal direction of the clamp elements 14. The operations of inserting the holding-open element 20 and opening the article 70 may be assisted by a jet of air directed onto the relevant article 70.

In the case of the clamp 12 which is shown on the far left in FIG. 13, the clamp elements 14 are located in the open position 18 and the clamp 12 is moved counter to the feed direction Z, this being indicated by the arrow 54, the articles 70 being transported in the feed direction Z at the same time. The clamp elements 14 are then transferred into the closed position 18', as is indicated with reference to the clamp elements 14 of the adjacent clamp 12 and the relevant arrows. The associated holding-open element 20 is then moved in the arrow direction toward the edge located opposite the fold edge 76, the so-called bloom, whereupon the holding-open element 20 is inserted between two adjacent parts 78, 78' of the relevant article 70, as is shown with reference to the third clamp 12 from the left. By virtue of the holding-open element 20 penetrating further into the article 70 and, if appropriate, of the holding-open element 20 rotating, the parts 78, 78' are spread further apart from one another. In this case, the holding-open element 20 is suitable for opening articles, in particular printed products, with or without an overfold.

The embodiment shown in FIG. 13 is suitable, in particular, when the articles 70 need not necessarily be opened in the center. This is the case, for example, if an insert or a trade sample does not have to be introduced into the opened article 70 at a specific page. The articles can be opened downstream of the feed apparatus 62 at any desired point in time.

Also suitable as opening apparatus 82 for the articles 70 which are to be fed are apparatuses such as those disclosed, for example, in EP-A-0 574 741; U.S. Pat. No. 5,441,245; EP-A-0 577 964; U.S. Pat. No. 5,443,250; CH-A-641 113; CH-A-644 815 and U.S. Pat. No. 4,420,146.

The clamp 12 may also be designed such that the clamp elements 14, instead of being moved in rotation, can be moved in a translatory manner toward one another and away from one another. It is also conceivable for the holding-open element 20 to be arranged such that it can be pivoted about an axis at right angles to its longitudinal direction. It is, of course, possible for the feed apparatus to be designed differently in a generally known manner.

It is conceivable for the movement path of the clamps 12 to run past the downstream end 64 of the feed apparatus 62, seen in the feed direction Z, obliquely, rather than at right angles, in relation to the feed direction Z.

What is claimed is:

1. A clamp for retaining flexible sheet articles with two or more parts, comprising:

two interacting clamp elements which are pivotable about an axis relative to one another from an open position into a closed position for retaining a flexible sheet article; and a holding-open element for engaging between two parts of the article and, when the clamp elements are located in the closed position, for keeping these parts separate from one another in a region outside the clamp elements;

said clamp elements and said holding-open element being arranged on a common carrying element which is driven in circulation along a movement path;

said holding-open element being longated on a longitudinal axis and mounted for rotation about its longitudinal axis.

2. The clamp as claimed in claim 1, wherein:

the holding-open element is rotatable in order, when the clamp elements are located in the closed position or are moving from the open position into the closed position, to spread apart the two parts of the article outside said clamp elements.

3. The clamp as claimed in claim 2, wherein:

the holding-open element being generally tongue-shaped;

said longitudinal axis being located substantially in a clamp plane defined by the clamp elements in the closed position.

4. The clamp as claimed in claim 3, wherein:

the clamp elements are pivotable about an axis which runs at least more or less at right angles to the longitudinal axis of the holding-open element.

5. The clamp as claimed in claim 1, wherein:

the holding-open element has two mutually parallel holding-open bars which are movable from a rest position, in which they are arranged adjacent to one another, into a spread position, in which they are spaced further apart from one another.

6. The clamp as claimed in claim 5, wherein:

the clamp elements are generally bar-shaped and are arranged at least more or less parallel to the holding-open bars; and wherein in each case one of the clamp elements and one of the holding-open bars are arranged on two levers which are mounted in an axis-parallel manner and are movable to the same extent in opposite directions.

7. The clamp as claimed in claim 6, wherein:

each of the levers is connected to a gearwheel, and the two gearwheels mesh with one another or with a rack running between them.

8. The clamp as claimed in claims 5, comprising:

arrangements for actuating the clamp elements and the holding-open element.

9. The clamp as claimed in claim 1, wherein:

the holding-open element is designed as an opening element and is intended, when the clamp elements are located in the closed position, for insertion between the two parts of the article and then keeping these parts separate from one another.

10. An apparatus for transporting flexible, sheet articles with two or more parts, comprising:

a plurality of clamps as claimed in claim 1, said clamps being arranged one behind the other, and movable along a movement path.

11. Use of a clamp as claimed in claim 1 for retaining flexible sheet articles, which have a fold, at an edge adjoining the fold.

12. The clamp element as claimed in claim 1, wherein the longitudinal axis of the holding-open element runs generally perpendicular with respect to the pivot axis of the clamp elements.

* * * * *